US007973717B2

(12) United States Patent
Meyers et al.

(10) Patent No.: US 7,973,717 B2
(45) Date of Patent: Jul. 5, 2011

(54) SYSTEM AND METHOD FOR AN INTEGRATED ANTENNA IN A CARGO CONTAINER MONITORING AND SECURITY SYSTEM

(75) Inventors: Richard C. Meyers, Arlington, VA (US); Ron Martin, Arlington, VA (US)

(73) Assignee: System Planning Corporation, Arlington, VA (US)

( * ) Notice: Subject to any disclaimer, the term of this patent is extended or adjusted under 35 U.S.C. 154(b) by 1187 days.

(21) Appl. No.: 11/598,829

(22) Filed: Nov. 14, 2006

(65) Prior Publication Data

US 2007/0200765 A1 Aug. 30, 2007

Related U.S. Application Data

(60) Provisional application No. 60/735,841, filed on Nov. 14, 2005.

(51) Int. Cl.
*H01Q 1/38* (2006.01)

(52) U.S. Cl. ..... 343/700 MS; 343/873

(58) Field of Classification Search ..... 343/700 MS, 343/873; 29/600
See application file for complete search history.

(56) References Cited

U.S. PATENT DOCUMENTS

| | | | | |
|---|---|---|---|---|
| 6,927,688 | B2 * | 8/2005 | Tice | 340/539.26 |
| 6,929,830 | B2 * | 8/2005 | Tei et al. | 427/575 |
| 7,450,083 | B1 * | 11/2008 | Baker | 343/873 |
| 7,652,636 | B2 * | 1/2010 | Forster et al. | 343/860 |

* cited by examiner

*Primary Examiner* — Tan Ho

(57) ABSTRACT

A system and method for an antenna which is constructed into or conforming onto the roof or wall of a cargo container is provided. The antenna system may have multiple antennas for short range wireless, cellular, global positioning, or satellite built into a single functional element. The antenna system may utilize a patch or phased array design. The method of construction of the antenna system may as part of the container fabricated or installed at the factory, applied as an adhesive film kit, or applied as a successive spray coating and etching process.

7 Claims, 3 Drawing Sheets

SYSTEM AND METHOD FOR AN INTEGRATED ANTENNA IN A CARGO CONTAINER MONITORING AND SECURITY SYSTEM

CLAIM OF PRIORITY

The present invention claims priority to U.S. Provisional Patent Application No. 60/735,841, filed Nov. 14, 2005.

BACKGROUND OF THE INVENTION

1. Field of the Invention

The present invention relates generally to container security and, more particularly, to a shipping container security system, and to the communication sub systems used in this system.

2. Background of the Invention

In today's security conscious transportation environment, there is a strong need to cost-effectively and accurately monitor the contents of containerized shipments. This need exists both in the United States and abroad.

Despite the strong need, until recently few solutions, if any, have been able to provide the protection and accuracy needed to suit the transportation industry and the government agencies charged with monitoring shipments. This lack of an acceptable solution is due to many factors which complicate interstate and international shipping. Shipping containers are used to transport most of the commerce entering, leaving, and transiting or moving within the United States. It is estimated that there are over 6 million containers moving in global commerce. Shipping containers have revolutionized the transportation of goods by greatly reducing the number of times goods must be loaded and unloaded during transport. However, at the same time, this same advantage has created a major problem in that it is very difficult to monitor and track the contents of each container during transport.

Beyond their basic construction, monitoring the content of shipping containers is also difficult because these containers are carried through numerous transit points and depots all over the world and it is impractical to stop and check the contents of each container individually at each point of transit. Dealing with this problem, the U.S. Customs Service estimates it can inspect just 5% of the 6 million containers entering and reentering the U.S. each year. Accordingly, agencies such as the United States Customs Service are seeking improved ways to achieve cargo container security and integrity upon arrival at the ports of entry of the United States.

To date, many government agencies have initiated programs to improve container security. These include many useful elements that are intended to preclude their use by terrorists. However, at present, none of the container tracking systems in use provides a way to assure the integrity of the contents of the containers to assure global container security. Current computer tracking systems are effective at monitoring the location of individual containers from point of origin to destination and maintaining an inventory of loaded and empty containers.

Many of these systems rely on communications devices mounted on or inside the containers that have external antenna elements which send messages regarding the status of the container and contents to satellites or ground stations, from which the messages are rerouted to shipping companies, freight forwarders, and companies through a central monitoring station. Some of these systems contain multiple modes of communication for various purposes including, short range wireless such as Bluetooth or 802.11 WiFi, cellular, or satellite connections. While the short range wireless is often used with the container, the cellular and satellite are required to communicate critical information about the status and contents of the container to the outside world and require antennas. Since the containers are almost universally constructed out of corrugated steel, signals transmitted through antennas on the interior of the container may have significant radio frequency path loss as much of the transmitted energy would be absorbed by the container walls. As a result, virtually all of these systems need to have some variation of external antenna device. However this is also problematic, in that it is often difficult to cable from a communications device located on the interior of the container with sensor to an antenna location on the exterior of the container. Also, for satellite communication the ideal location for the antenna is often on the container roof, but as containers are stacked the antennas may easily get damaged or crushed. The proper operation of the communications devices of these systems is critical, and when it is not possible to communicate, the entire functionality of the system is compromised. Conventional antennas mounted on the exterior of containers may have multiple disadvantages, in that they: may interfere with normal container handling process; may be damaged when containers are stacked or moved; may become detached during the container handling process; may appear obvious to the casual observer which may not be desirable for discreet monitoring of containers; and may be easily defeated by a person or persons who wish to interfere with a container monitoring system for subversive purposes.

For these reasons, it is desirable to have an antenna system that can be integrated into the top or side of container wall itself. A system such as this would have multiple advantages including: avoiding change in current methods of container handling; difficult or impossible to detach or damage; hidden from view as it looks like all other containers; no field installation of an external antenna; and lower cost than separate antenna systems.

The invention described herein, provides an alternative safe, and reliable, and cost effective alternative antenna system which is actually integrated into the container roof or wall.

Description of the Related Art

A container security system as described by System Planning Corporation (SPC) (U.S. Pat. No. 7,098,784) herein referred to as "the SPC Invention", performs many of the functions to monitor containers, their content, and to detect tampering within a container during transit. This is accomplished through a device is which located on a container, which performs multiple functions. Some of these functions may include controlling various sensors, collecting the data from these sensors and transmitting this data back to a central monitoring station. The central monitoring stations may also send commands and information to individual containers equipment with this device.

To enable information to be transmitted to and from the container, there are several communications subsystems including a satellite or cellular communications device, or both. This system also describes the utilization of a global positioning element, and short range wireless or local area communication channel to communicate with various sensors and other elements within the container.

In the SPC invention, the antenna device or which interface to the communication subsystem and the global positioning element is mounted on the exterior of the container. In this case it can be easily damaged, limits the ability to effectively stack containers, and it may appear obvious to any person.

SUMMARY OF THE INVENTION

To address the problem and limitations noted above, a system which can provide an alternative antenna system is provided. The system in the present invention is integrated or built into the container structure. It may be installed in the factory, or variations thereof in the field at the time of system installation. It is highly concealed, and does not limit the stacking or other common movement of containers during the shipping process.

The preferred embodiments of this invention provide an antenna system for several separate communications devices which may include: a short range wireless or a wireless local area connection (WLAN) communications device; a cellular communications device, a global positioning device, and a satellite communications device. The system also may contain a global positioning device.

In the present invention, the antenna is integrated into the walls, roof, or door of the container. There are several methods for construction of the antenna. In one method, the antenna is built directly into the container as a permanently affixed device at the time of container manufacture. In another method, the antenna is placed on the container either at the time of manufacture or during field installation. In yet another method, the antenna is applied using a spray coating technique for the various layers.

The accompanying drawings, which are incorporated in and constitute a part of this specification, illustrate various embodiments of the invention and, together with the description, serve to explain the principles of the invention.

DESCRIPTION OF THE PREFERRED EMBODIMENTS

The present invention provides a unique system for integrating an antenna system into or on a cargo container. The antenna may service the radio frequency transmission and reception for multiple communications devices and a global positioning device.

Throughout this specification, preferred embodiments of the invention are described in detail below with reference to the accompanying drawings. In the embodiments, various examples and illustrative embodiments are provided. It should be understood that these embodiments and examples are provided purely for purposes of illustration. The present invention is limited solely by the claims appended hereto.

Figure 1:
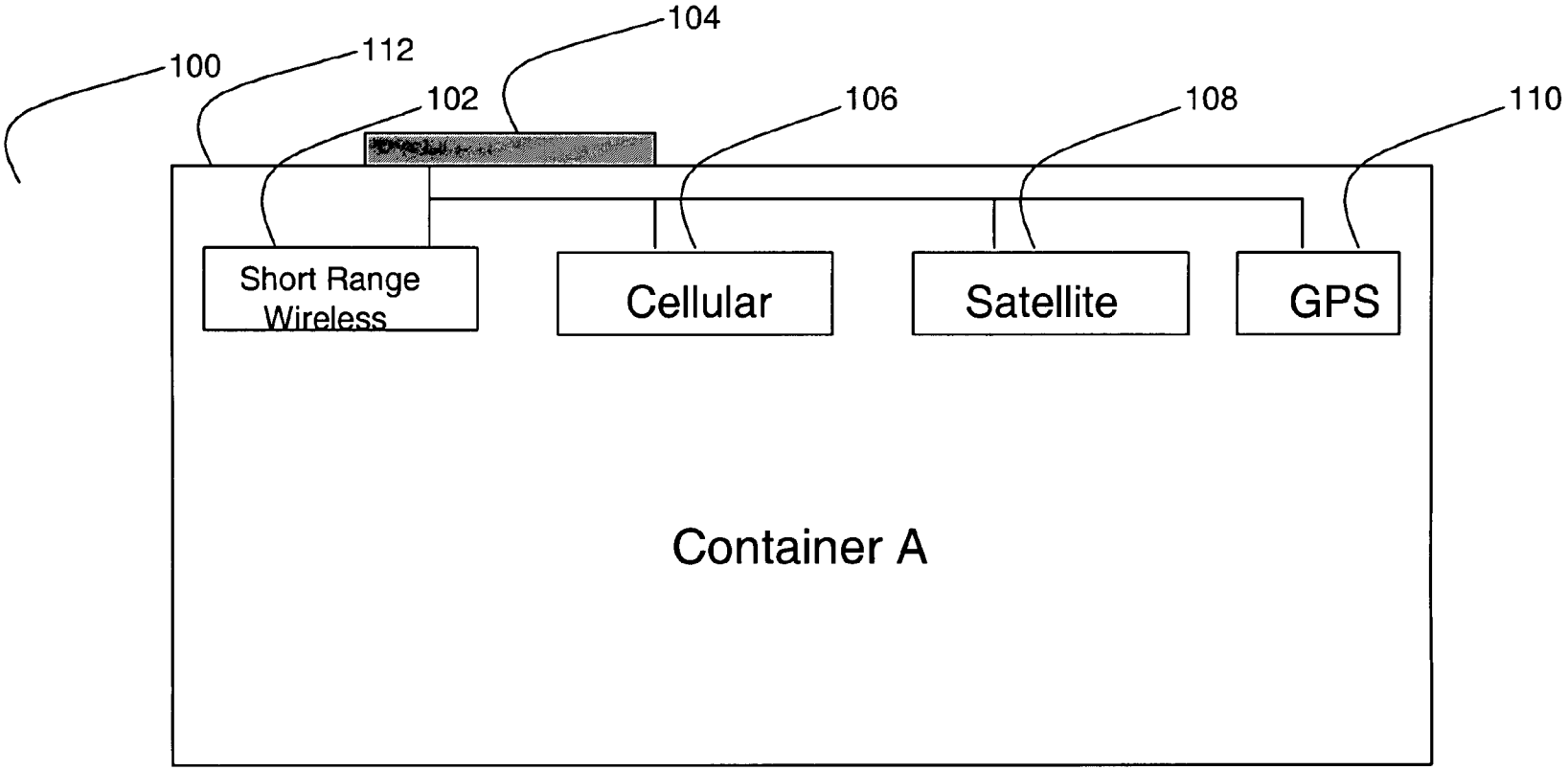
FIG. 1 shows a functional configuration of the integrated antenna for either satellite, cellular, GPS, or short range wireless communications devices.

With reference now to FIG. 1, and for the purposes of explanation, an environment 100 includes an antenna system 104, which is integrated into a container 112. The integrated antenna system 104 provides a radio frequency interface for various elements. One of these elements is a short range wireless communications device 102 associated with each container. Each short range wireless communications device may include a transmitter element and a complementary receiver element. Another element includes at least one long range communications device associated with each container. The long range communications device may include a satellite communication device 108, a cellular communications device 106, and global positioning or GPS device 110.

Again in FIG. 1 the short range wireless communications device 102 located on each container may be capable of transmitting and receiving data and messages via a radio frequency signal at a maximum predetermined distance from a few feet to a several hundred feet, and implements a communication protocol comprising any one of standards including Bluetooth, Zigbee, 802.11 series, and a proprietary short range wireless channel. The cellular communications device 106 implements one of a cellular standard or a proprietary wireless protocol and network suited to transmit data over a network between long distances of at least hundreds of miles. The satellite communications device 108 includes a transmitter element and a receiver element, which may communicate with either a geosynchronous (GEO) or Low Earth Orbit (LEO) satellite in a network. In FIG. 1 the antenna system 102 may be an integrated unit servicing the individual antenna requirements for the transmission and reception of any one of the communication and positions elements, 102, 104, 106, 108, or 110.

In the preferred embodiments of the invention, the antenna system 104 may be integrated into, and conform to the actual roof or wall of the container which is normally a corrugated steel form, used to provide extra rigidity and strength to the container 112. In the preferred embodiments of the invention, the antenna system 104 may be constructed using flat or planar design, conforming to the container construction and having a patch or phased array antenna design. The antenna system 104 may be constructed using a method of dielectric and etched transmission elements on the container wall of roof, using a patch or phased array antenna, and may include multiple layer construction. These layers may include a steel or other reinforcement material layer designed for wall strength, dielectric layer or layers providing electrical isolation, and a conductive layer which may act as the antenna and transmission element. While these may apply to the more sophisticated antenna, embodiments of the present invention would provide a simple singe pole, stripline, or other applicable antenna for the global positioning element 110 and the short range wireless communication device 102 where the application required this type of design.

In most cases a feed cable or connector may be provided which passes through the roof or wall of the container to the interior to easily connect to electronics located within the container interior, but the cable may also be routed through an opening in the door or other existing crevice.

Figure 2:
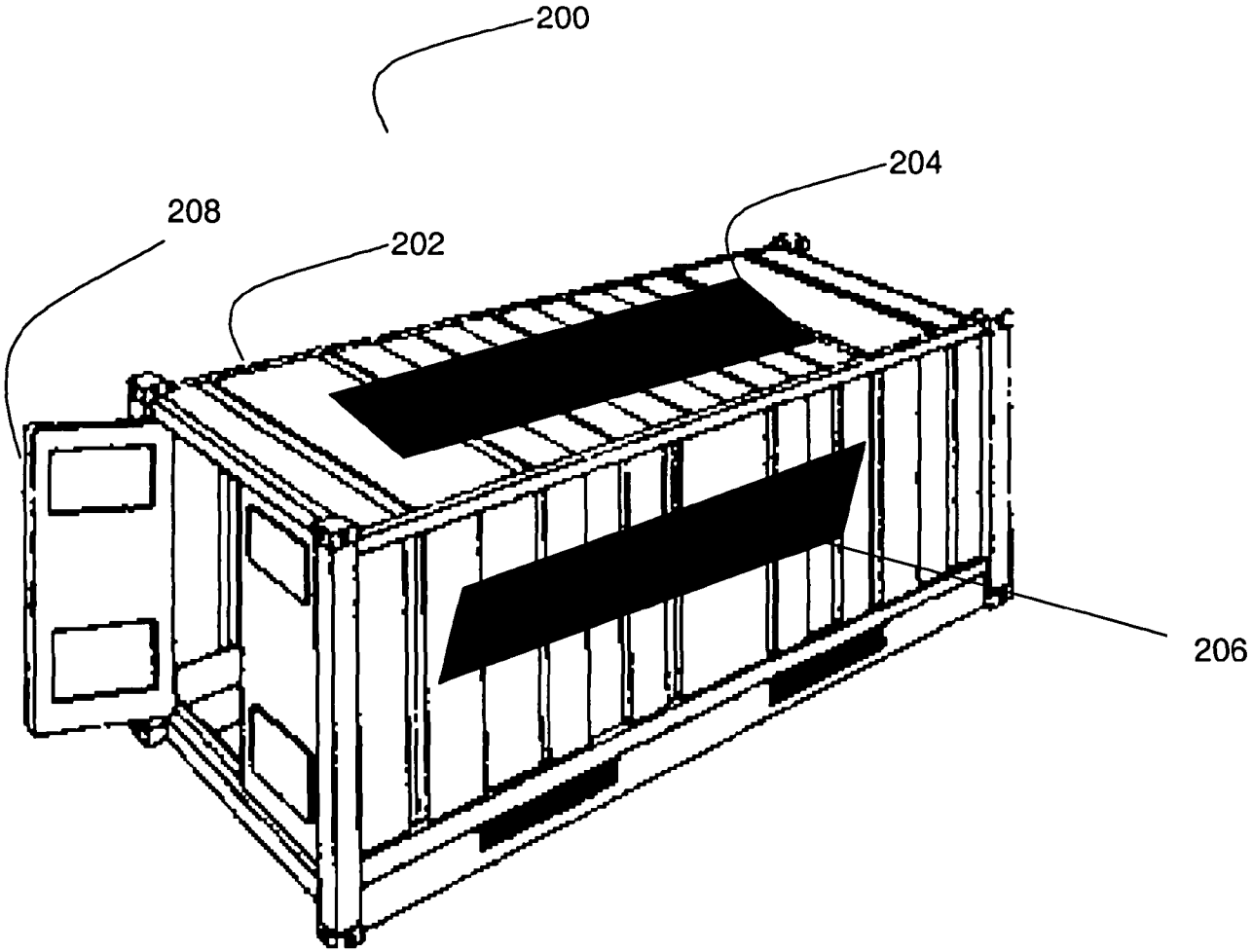
FIG. 2 shows a mechanical placement of the integrated antennas into the roof, wall of door area of the cargo container.

As shown in FIG. 2, examples of the mechanical placement of the antenna system may vary depending on the particular container and application. In all cases the antenna system is located on the exterior of the container. In FIG. 2 on container 202, the antenna may be constructed on a roof 204 of the container, or on any of the side walls 206 of the container, or alternatively on the face of the door 208. The antenna system may not be apparent to the casual observer and as such it may be constructed in a manner in which is it concealed such that it appears from the exterior to have the same characteristics of a normal shipping container.

In may cases the satellite communication system used are Low Earth Orbit (LEO) systems. In this case these satellites pass over the horizon in accordance with their orbit patterns. In these cases it may be preferable to direct more energy or achieve a high gain when receiving. This can be accomplished by electrically altering the beam pattern through the activation of various array elements such that the antenna may achieve higher gain in tracking a LEO satellite as it crosses the horizon Alternatively, the antenna may have the ability to point at different Geosynchronous Orbit (GEO) satellites depending on the physical location of the container.

Figure 3:
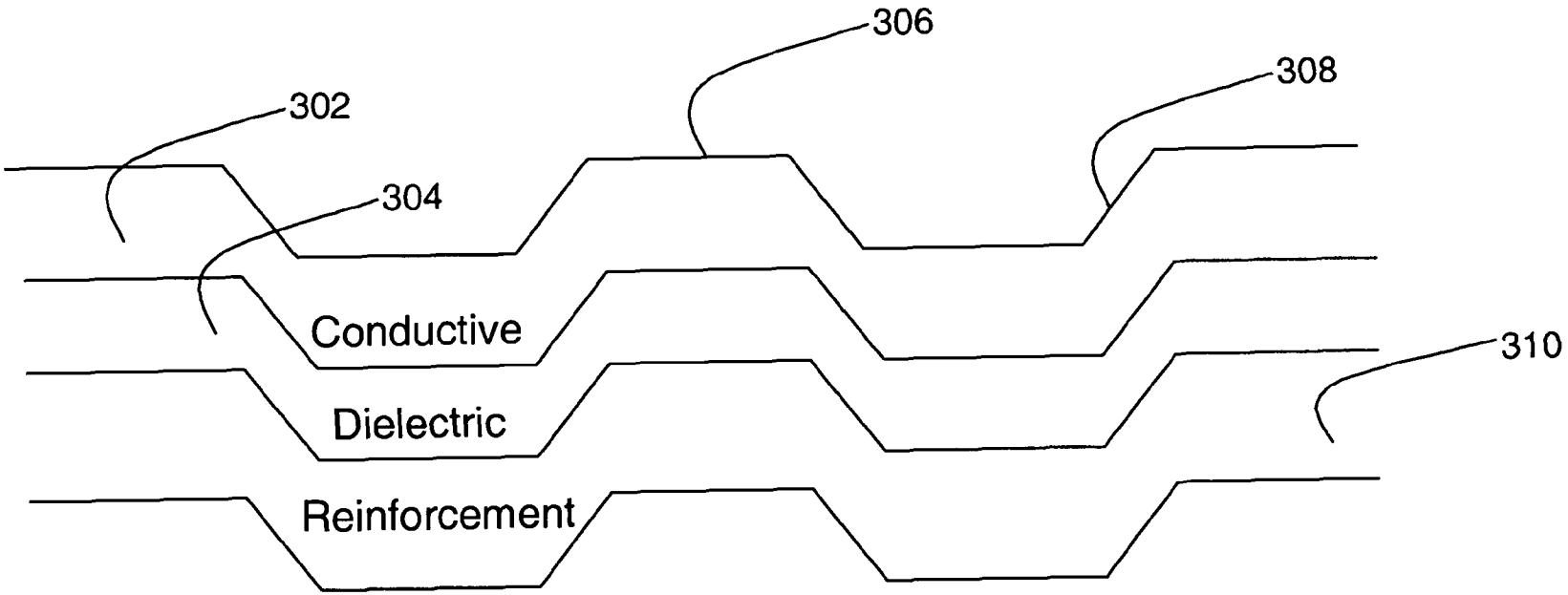
FIG. 3 shows the construction of various methods for the integrated antenna.

As indicated in the example in FIG. 3, the methods for constructing of the integrated antenna may comprise incorporating a series of layered materials which may include a reinforcement layer 310. The reinforcement layer 310 may be constructed from of steel or other hardened or rigid material. A dielectric layer 304 may include an insulating material having characteristics of a predetermined dielectric constant, or a conductive layer 302 which may act as the antenna and transmission element. In some cases the container may not be manufactured from a corrugated steel frame, but from a hardened material that possesses the dielectric properties and the rigidity properties suitable for that of a durable transport container. An example of this may be a container manufactured from a plastic or other non-conductive composite. In this manner the reinforcement layer 310 is combined with the dielectric layer 304.

The container may be pre-manufactured and assembled as part of the container itself as opposed to being installed in the field. Alternatively, the dielectric layer 304 and conductive layers 302 are applied as a separate film which has self adhesive properties or is adhered using an adhesive material to said reinforcement layer, and may be applied to a standard shipping container during or after construction. Yet another alternative method for the antenna system construction comprises successively applying the dielectric layer 304 and conductive layers 302 as a spray film, or other chemical application method, and performing etching using a conventional etching process.

Again in FIG. 3, in a preferred embodiment of the present invention, another alternative may improve the antenna propagation characteristics and gain. In this alternative, the dielectric and propagation layers are only applied to horizontal or vertical corrugated areas 306, and not applied to the angular corrugated areas 308. Also in a preferred embodiment, as opposed to completely omitting the dielectric and conductive layers, 304 and 302 respectively, the dielectric and conductive properties of these layers may be varied according to the surface of a container roof or wall, so as to allow optimal propagation for the horizontal or vertical corrugated areas 306, and attenuated propagation for the angular corrugated areas 308.

What is claimed is:

1. A method for constructing an antenna system for a container having at least one container wall, wherein the container wall is constructed from a series of layered materials including a reinforcement layer constructed from a rigid material and a dielectric layer constructed from an insulating material having a predetermined dielectric constant, the method comprising:

incorporating a conductive layer within the container wall, wherein the conductive layer is configured to act as an antenna; and applying the dielectric layer and the conductive layer as spray films.

2. The method of claim 1, further comprising combining the reinforcement layer with said dielectric layer, such that the resultant layer has the dielectric properties and the rigidity properties suitable for that of a durable transport container.

3. The method of claim 1, further comprising providing a construction that has been pre-manufactured and assembled as part of the container.

4. A method for constructing an antenna system for a container having at least one container wall comprised of horizontal and vertical corrugated areas, wherein the container wall is constructed from a series of layered materials including a reinforcement layer constructed from a rigid material and a dielectric layer constructed from an insulating material having a predetermined dielectric constant, the method comprising:

incorporating a conductive layer within the container wall, wherein the conductive layer is configured to act as an antenna; and applying the dielectric and conductive layers only to the horizontal corrugated areas.

5. A method for constructing an antenna system for a container having at least one container wall comprised of horizontal, vertical and angular corrugated areas, wherein the container wall is constructed from a series of layered materials including a reinforcement layer constructed from a rigid material and a dielectric layer constructed from an insulating material having a predetermined dielectric constant, the method comprising:

incorporating a conductive layer within the container wall, wherein the conductive layer is configured to act as an antenna; and varying the dielectric and conductive layers based on whether they cover a horizontal, vertical or angular corrugated area.

6. A method for constructing an antenna system for a container having at least one container wall comprised of horizontal and vertical corrugated areas, wherein the container wall is constructed from a series of layered materials including a reinforcement layer constructed from a rigid material and a dielectric layer constructed from an insulating material having a predetermined dielectric constant, the method comprising:

incorporating a conductive layer within the container wall, wherein the conductive layer is configured to act as an antenna; and applying said dielectric layer and conductive layers as a separate film using an adhesive material applied to the reinforcement layer.

7. The method of claim 6, further comprising applying said dielectric layer and conductive layers as separate films having self adhesive properties.

* * * * *